US009742123B2

(12) United States Patent
Yokoyama

(10) Patent No.: US 9,742,123 B2
(45) Date of Patent: Aug. 22, 2017

(54) CONNECTOR

(71) Applicant: JAPAN AVIATION ELECTRONICS INDUSTRY, LIMITED, Shibuya-ku, Tokyo (JP)

(72) Inventor: Yohei Yokoyama, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/309,333

(22) PCT Filed: May 15, 2015

(86) PCT No.: PCT/JP2015/064037
§ 371 (c)(1),
(2) Date: Nov. 7, 2016

(87) PCT Pub. No.: WO2015/186491
PCT Pub. Date: Dec. 10, 2015

(65) Prior Publication Data

US 2017/0085039 A1 Mar. 23, 2017

(30) Foreign Application Priority Data

Jun. 2, 2014 (JP) ..... 2014-114208

(51) Int. Cl.
*H01R 13/6591* (2011.01)
*H01R 13/648* (2006.01)
(Continued)

(52) U.S. Cl.
CPC ..... *H01R 13/6591* (2013.01); *H01R 13/648* (2013.01); *H01R 24/60* (2013.01); *H01R 2107/00* (2013.01)

(58) Field of Classification Search
CPC .. H01R 13/6591; H01R 13/648; H01R 24/60; H01R 2107/00
(Continued)

(56) References Cited

U.S. PATENT DOCUMENTS 5,685,739 A * 11/1997 Davis ..... H01R 23/6873 439/607.38
8,021,188 B1 * 9/2011 Ma ..... H01R 12/722 439/607.55
(Continued)

FOREIGN PATENT DOCUMENTS

JP 05001182 U 1/1993
JP 2001501015 A 1/2001
(Continued)

OTHER PUBLICATIONS

International Search Report (ISR) and Written Opinion dated Jun. 23, 2015 issued in International Application No. PCT/JP2015/064037.

*Primary Examiner* — Alexander Gilman
(74) *Attorney, Agent, or Firm* — Holtz, Holtz & Volek PC

(57) ABSTRACT

A connector includes a holding member, a contact, a shell and a ground member. The holding member is made of insulator defining a connection space. The contact has a contact point. The contact is held by the holding member. The contact point is located inside the connection space. The ground member is electrically connected to the shell. The ground member has a base portion, a ground spring portion and a ground contact point portion. The base portion is located between the holding member and the shell. The base portion is provided with a regulated portion sandwiched between the shell and the holding member. The ground spring portion extends from the base portion. The ground contact point portion is supported by the ground spring portion and protrudes into the connection space. In the
(Continued)

front-rear direction, a position of the ground spring portion does not overlap with a position of the contact.

11 Claims, 8 Drawing Sheets

(51) Int. Cl.
*H01R 24/60* (2011.01)
*H01R 107/00* (2006.01)

(58) Field of Classification Search
USPC ..... 439/607.35, 607.55–607.57
See application file for complete search history.

(56) References Cited

U.S. PATENT DOCUMENTS 8,388,379 B2 * 3/2013 Sasaki ..... H01R 12/724 439/607.35
9,590,363 B2 * 3/2017 Wu ..... H01R 13/6585
9,627,817 B2 * 4/2017 Chang ..... H01R 13/6581
2005/0227537 A1 * 10/2005 Peng ..... H01R 13/6582 439/607.01
2014/0017951 A1 * 1/2014 Tsai ..... H01R 13/516 439/638
2015/0194772 A1 * 7/2015 Little ..... H01R 13/6597 439/357
2015/0222059 A1 * 8/2015 Little ..... H01R 13/6587 439/607.55
2016/0149350 A1 * 5/2016 Kao ..... H01R 24/60 439/607.05
2016/0380388 A1 * 12/2016 Guo ..... H01R 24/60 439/83
2017/0033507 A1 * 2/2017 Tsai ..... H01R 24/62
2017/0040721 A1 * 2/2017 Tsai ..... H01R 13/502
2017/0040749 A1 * 2/2017 Tsai ..... H01R 13/6587
2017/0047689 A1 * 2/2017 Yao ..... H01R 13/652
2017/0054258 A1 * 2/2017 Little ..... H01R 24/60
2017/0077651 A1 * 3/2017 Chang ..... H01R 13/6594
2017/0085037 A1 * 3/2017 Chen ..... H01R 13/6585
2017/0085038 A1 * 3/2017 Duan ..... H01R 24/64
2017/0085040 A1 * 3/2017 Tsai ..... H01R 13/6585
2017/0093091 A1 * 3/2017 Cheng ..... H01R 13/6471

FOREIGN PATENT DOCUMENTS

JP 2011154954 A 8/2011
JP 2012069353 A 4/2012
JP 2012069354 A 4/2012

* cited by examiner

CONNECTOR

TECHNICAL FIELD

This invention relates to a connector which is provided with a ground contact point portion to be connected to a mating ground portion of a mating connector.

BACKGROUND ART

For example, a connector disclosed in Patent Document 1 is provided with a shell 900 having ground contact point portions 950 like that mentioned above. As shown in FIG. 15, the shell 900 of Patent Document 1 has a main portion 910, folded portions 930 and spring portions 940. The folded portions 930 are folded over at a front end 920 of the main portion 910. The spring portions 940 extend from the folded portions 930. The spring portions 940 are provided with ground contact point portions 950 which come into contact with a mating shell (not shown). Since the folded portions 930 like these are provided, the spring portions 940 can be formed without forming notches (apertures) in the main portion 910. Accordingly, shielding characteristics of the shell 900 are never impaired.

PRIOR ART DOCUMENTS

Patent Document(s)

Patent Document 1: JPA2011-154954

SUMMARY OF INVENTION

Technical Problem

In the shell 900 of Patent Document 1, positions of the ground contact point portions 950 are too far from a front end of the connector. Therefore, there is a possibility that connection between contacts is performed before the ground contact point portions 950 of the shell 900 are connected to the mating shell (not shown).

The present invention aims at providing a connector having a structure in which a ground contact point portion is located near a front end of the connector.

Solution to Problem

One aspect of the present invention provides a connector mateable with a mating connector, which has a mating ground portion, in a front-rear direction. The connector comprises a holding member, a contact, a shell and a ground member. The holding member is made of insulator defining a connection space. The contact has a contact point. The contact is held by the holding member. The contact point is located inside the connection space. The shell covers the holding member at least in part. The ground member is electrically connected to the shell. The ground member has a base portion, a ground spring portion and a ground contact point portion. The base portion is located between the holding member and the shell. The base portion is provided with a regulated portion sandwiched between the shell and the holding member. Movement of the regulated portion is regulated. The ground spring portion extends from the base portion. The ground spring portion has a first spring portion, a second spring portion and a third spring portion. The first spring portion extends rearward in the front-rear direction. The second spring portion extends from a rear end of the first spring portion in a lateral direction perpendicular to the front-rear direction. The third spring portion extends forward in the front-rear direction from the second spring portion. The ground contact point portion is connected to the mating ground portion when the connector is mated with the mating connector. The ground contact point portion is supported by the third spring portion and protrudes into the connection space. In the front-rear direction, a position of the ground spring portion does not overlap with a position of the contact.

Advantageous Effects of Invention

The ground contact point portion is provided on the ground member which is different and distinct from the shell. Accordingly, degrees of structural freedom of the ground contact point portion and the ground spring portion, which supports the ground contact point portion resiliently, can be enhanced, and the ground contact point portion can be brought close to a front end of the connector.

Moreover, since the ground member is electrically connected to the shell, grounding function can be provided, which is same in electrical characteristics as that in a case where the ground contact point portion is provided on the shell.

Especially, since the ground spring portion has the first spring portion, the second spring portion and the third spring portion, relatively long total spring length can be secured even if a space is limited in the front-rear direction. Therefore, enough contact pressure of the ground contact point portion for the mating ground portion can be secured by increasing displacement amount of the ground contact point portion.

An appreciation of the objectives of the present invention and a more complete understanding of its structure may be had by studying the following description of the preferred embodiment and by referring to the accompanying drawings.

DESCRIPTION OF EMBODIMENTS

Figure 1:
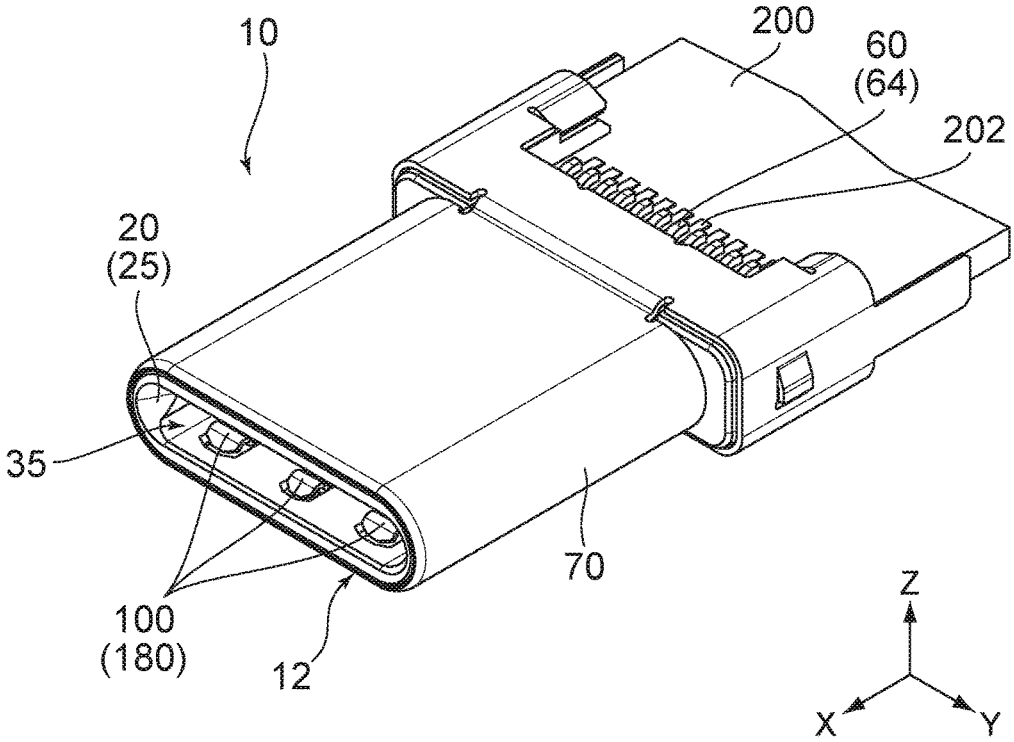
FIG. 1 is a perspective view showing a connector according to an embodiment of the present invention.
Figure 2:
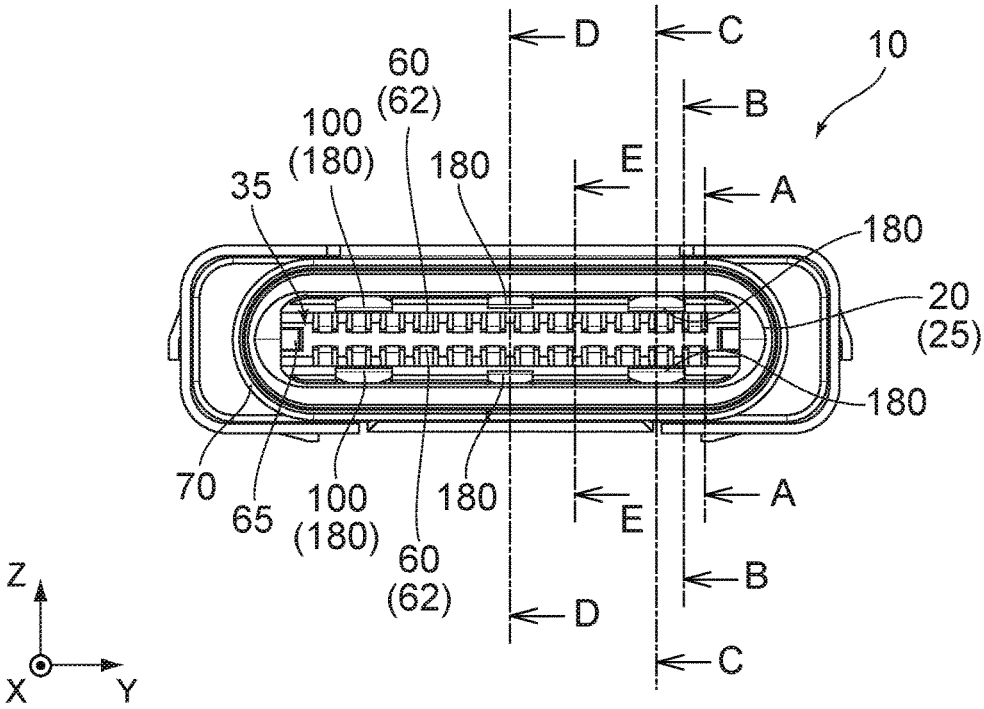
FIG. 2 is a front view showing the connector of FIG. 1.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

Referring to FIGS. 1 to 4, a connector 10 according to an embodiment of the present invention is mateable, along an X-direction, with a mating connector (not shown) having a mating ground portion (not shown). As understood from FIGS. 1 and 2, the connector 10 according to the present embodiment has a symmetry structure in a Y-direction. As understood from FIG. 4, the connector 10 also has a symmetry structure in a Z-direction. In the present description, the X-direction, the Y-direction and the Z-direction are referred as a front-rear direction, a lateral direction and an up-down direction, respectively. Especially, a positive X-direction is a forward direction, and a negative X-direction is a rearward direction.

Figure 3:
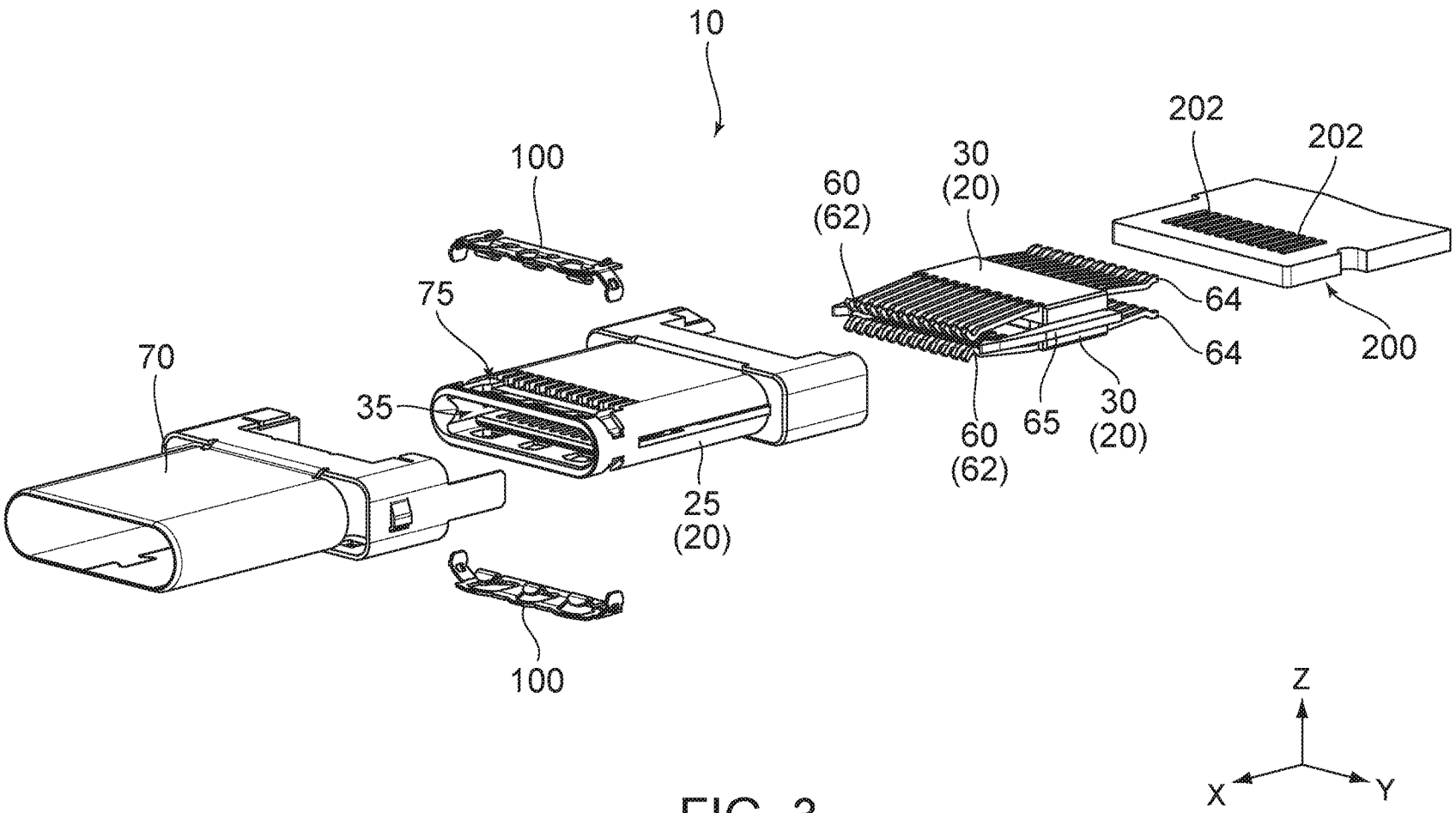
FIG. 3 is an exploded, perspective view showing the connector of FIG. 1.

As shown in FIG. 3, the connector 10 is provided with a holding member 20, a plurality of contacts 60 made of conductor, a ground plate 65 made of conductor, a shell 70 made of metal, and ground members 100 made of conductor.

Figure 4:
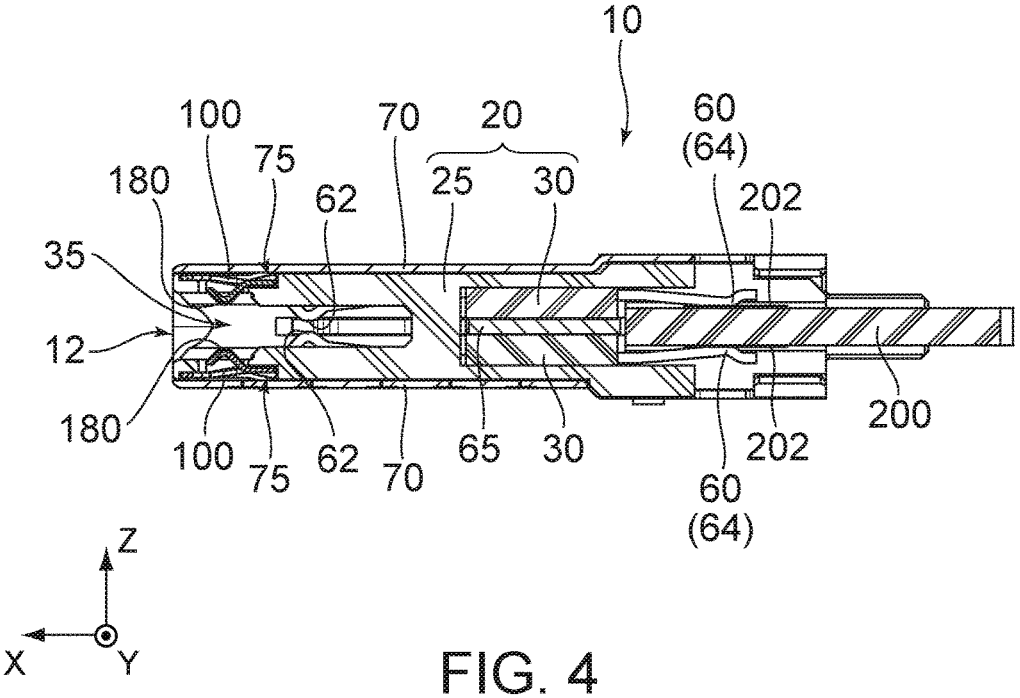
FIG. 4 is a cross-sectional view showing the connector of FIG. 2, taken along line D-D.

As understood from FIGS. 3 and 4, the holding member 20 is provided with a primary member 25 made of insulator and secondary members 30 made of insulator. The secondary members 30 are accommodated in the primary member 25. In the present embodiment, the number of the secondary members 30 is two. In other words, the holding member 20 of the present embodiment consists of three members. However, the present invention is not limited thereto. The holding member 20 may consist of one member.

Figure 5:
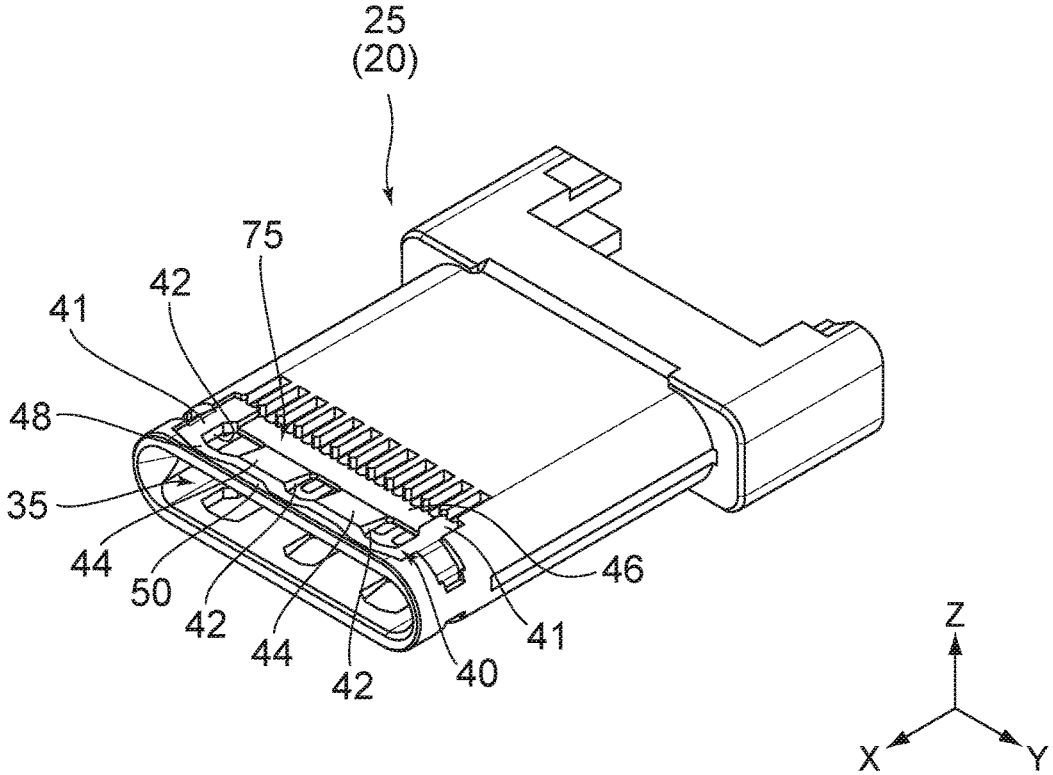
FIG. 5 is a perspective view showing a primary member of a holding member of FIG. 3.

As shown in FIG. 5, the primary member 25 of the holding member 20 defines a connection space 35. As shown in FIGS. 1 and 4, the connection space 35 opens in a front end 12 of the connector 10.

Figure 10:
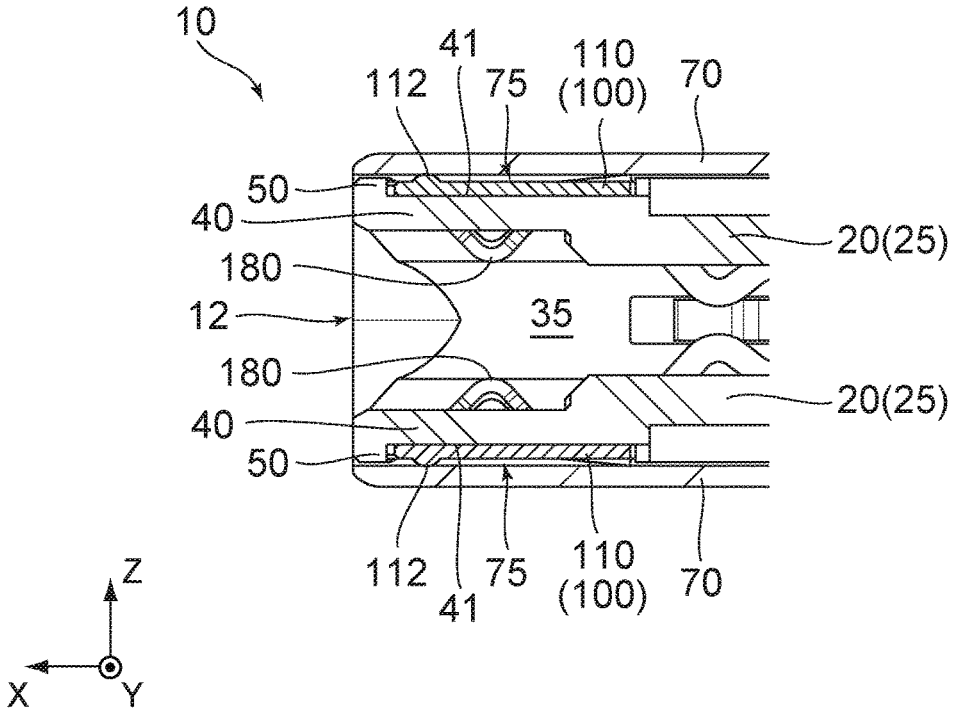
FIG. 10 is an enlarged, cross-sectional view showing a part of the connector of FIG. 2, taken along line A-A.
Figure 11:
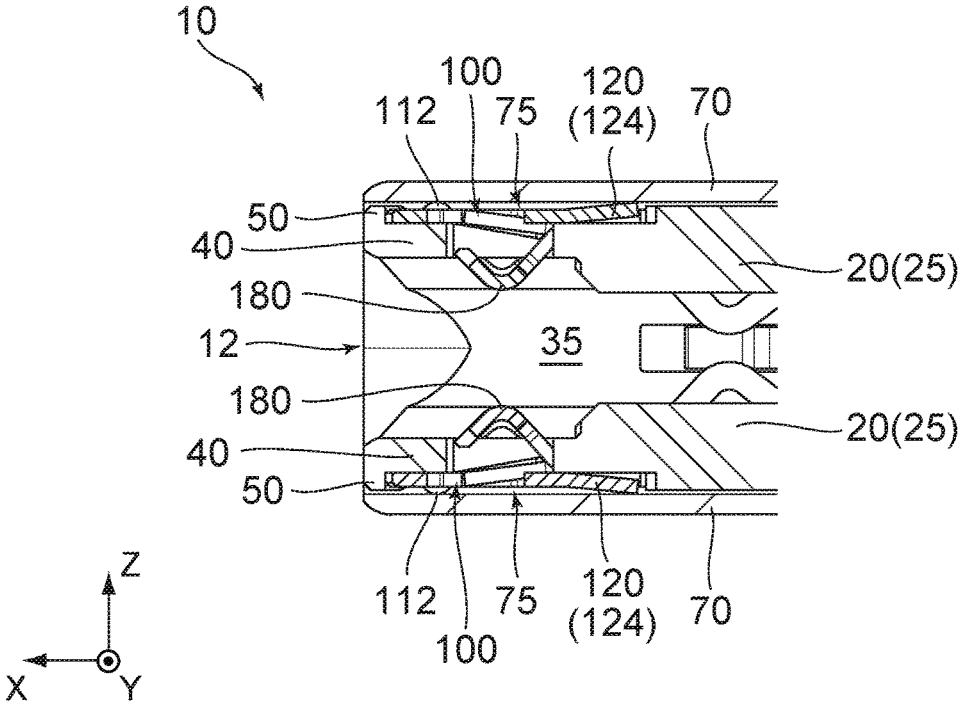
FIG. 11 is an enlarged, cross-sectional view showing the part of the connector of FIG. 2, taken along line B-B.
Figure 14:
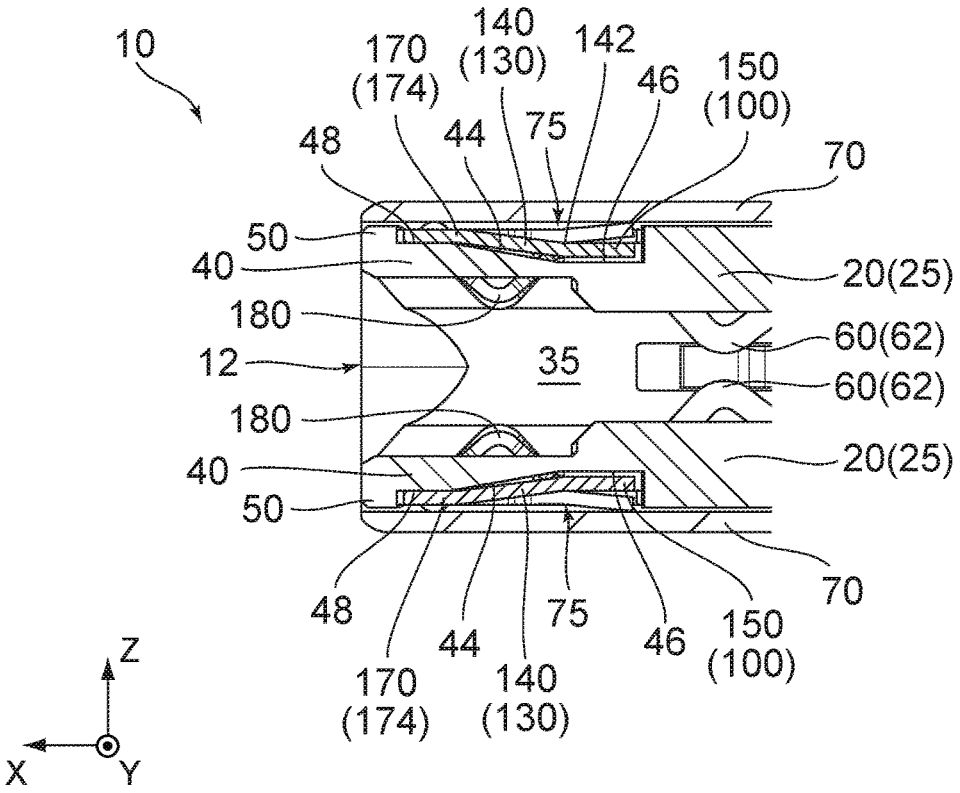
FIG. 14 is an enlarged, cross-sectional view showing the part of the connector of FIG. 2, taken along E-E line.
Figure 15:
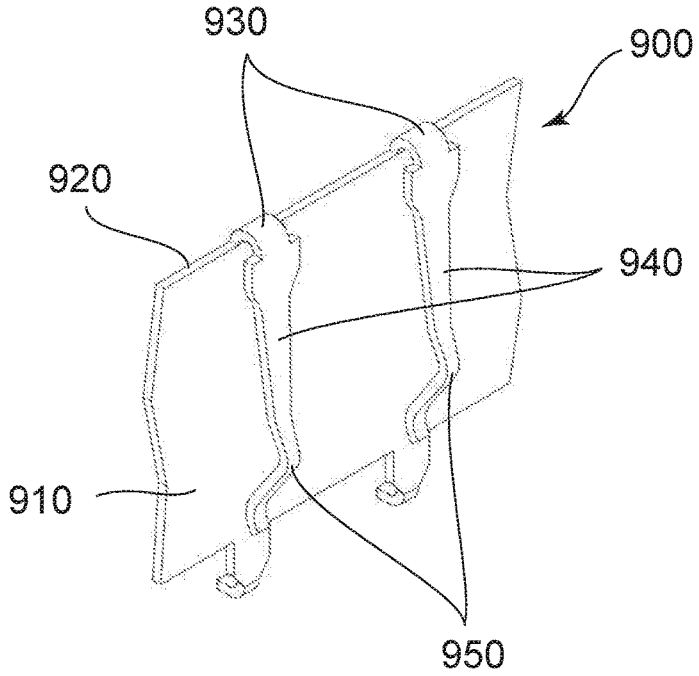
FIG. 15 is a perspective view showing a part of a shell of Patent Document 1.

Referring to FIG. 5, the primary member 25 is formed with a partition wall 40, three apertures 42 and a front wall 50. Each of the apertures 42 penetrates the partition wall 40 in the up-down direction. The front wall 50 is located forward of the partition wall 40. As shown in FIGS. 11 and 14, the partition wall 40, the front wall 50 and the shell 70 form a ground accommodation portion 75. In detail, the partition wall 40 separates the ground accommodation portion 75 and the connection space 35 from each other, and the front wall 50 separates the ground accommodation portion 75 and a space in front of the connector 10 from each other. As shown in FIG. 5, the partition wall 40 has two reference surface portions 41, two first regulating portions 44, a second regulating portion 46 and an additional regulating portion 48. As shown in FIG. 10, the reference surface portion 41 forms a plane perpendicular to the up-down direction. Similarly, as shown in FIG. 14, each of the second regulating portion 46 and the additional regulating portion 48 forms a plane perpendicular to the up-down direction. The second regulating portion 46 is located inward of the additional regulating portion 48 in the up-down direction. As shown in FIG. 5, the reference surface portions 41 and the additional regulating portion 48 of the present embodiment form the same plane as each other. Each of the first regulating portions 44 is located between two of the apertures 42 in the lateral direction. As shown in FIG. 14, the first regulating portion 44 extend diagonally to be directed inward in the up-down direction and to be directed rearward and connect the second regulating portion 46 and the additional regulating portion 48 to each other. In other words, the first regulating portion 44 forms an inclined plane intersecting diagonally with the front-rear direction. As shown in FIG. 5, the additional regulating portion 48 and the front wall 50 have convexo-concave shapes in conformity with a shape of a part of the ground member 100 mentioned later.

As shown in FIGS. 3 and 4, each of the contacts 60 has a contact point 62 and a connection portion 64. The contact point 62 is a part to be connected to a mating contact point (not shown) of the mating connector (not shown). As understood from FIGS. 1 and 4, the connection portion 64 is connected to a pad 202 of a relay board 200. To the relay board 200, for example, a cable or the like is connected.

Figure 12:
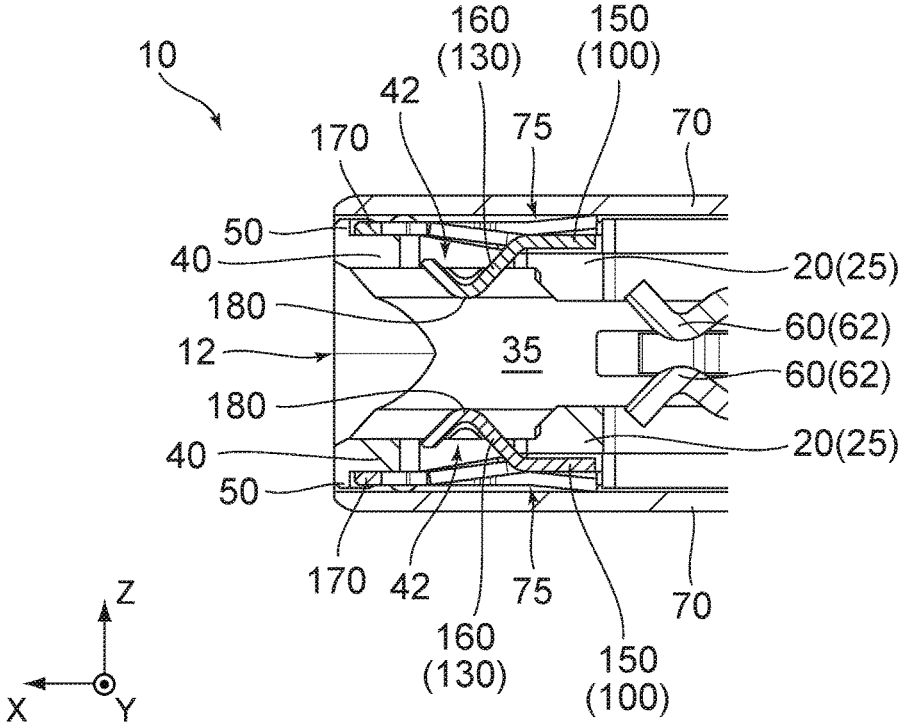
FIG. 12 is an enlarged, cross-sectional view showing the part of the connector of FIG. 2, taken along line C-C.
Figure 13:
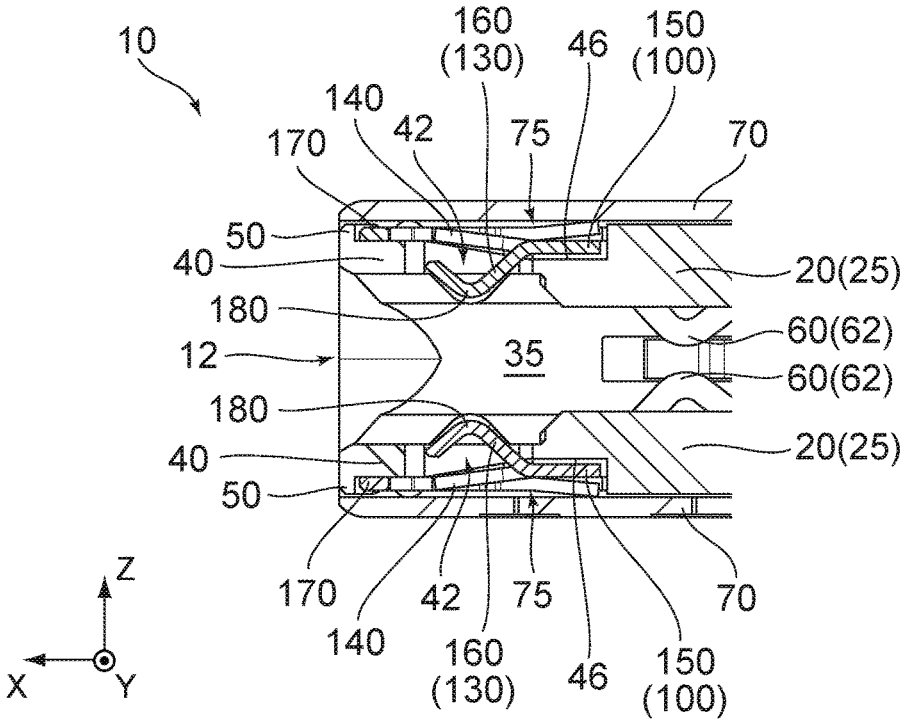
FIG. 13 is an enlarged, cross-sectional view showing the part of the connector of FIG. 2, taken along D-D line.

As understood from FIG. 3, the plurality of the contacts 60 is divided into two groups. The contacts 60 of each of the groups are held by the secondary member 30 and arranged in the lateral direction (pitch direction). The ground plate 65 is sandwiched between the two secondary members 30 in the up-down direction. The ground plate 65 is integrally formed with lock spring portions. The lock spring portions are provided with lock portions which lock locked portions (not shown) of the mating connector (not shown). The secondary members 30 holding the contacts 60 and the ground plate 65 are accommodated in the primary member 25. Thus, as shown in FIGS. 4, 12 and 13, the contact point 62 is located in the connection space 35.

As understood from FIGS. 1 and 4, the shell 70 covers the holding member 20.

Figure 9:
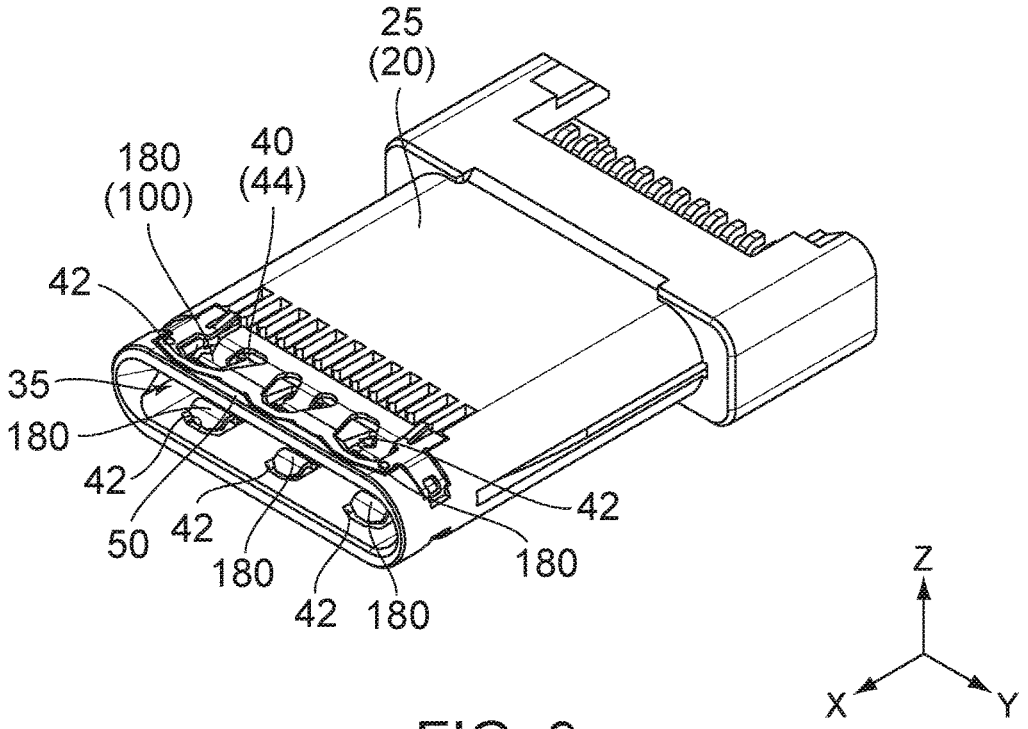
FIG. 9 is a perspective view showing the primary member of the holding member and the ground members of FIG. 3.

In a state where the ground members 100 are mounted on the partition walls 40 of the holding member 20 as shown in FIG. 9, the shell 70 is attached to the holding member 20 as understood from FIGS. 1 and 4. Thus, as shown in FIGS. 4, 11 and 14, the ground members 100 are accommodated in the ground accommodation portions 75 in part.

Figure 6:
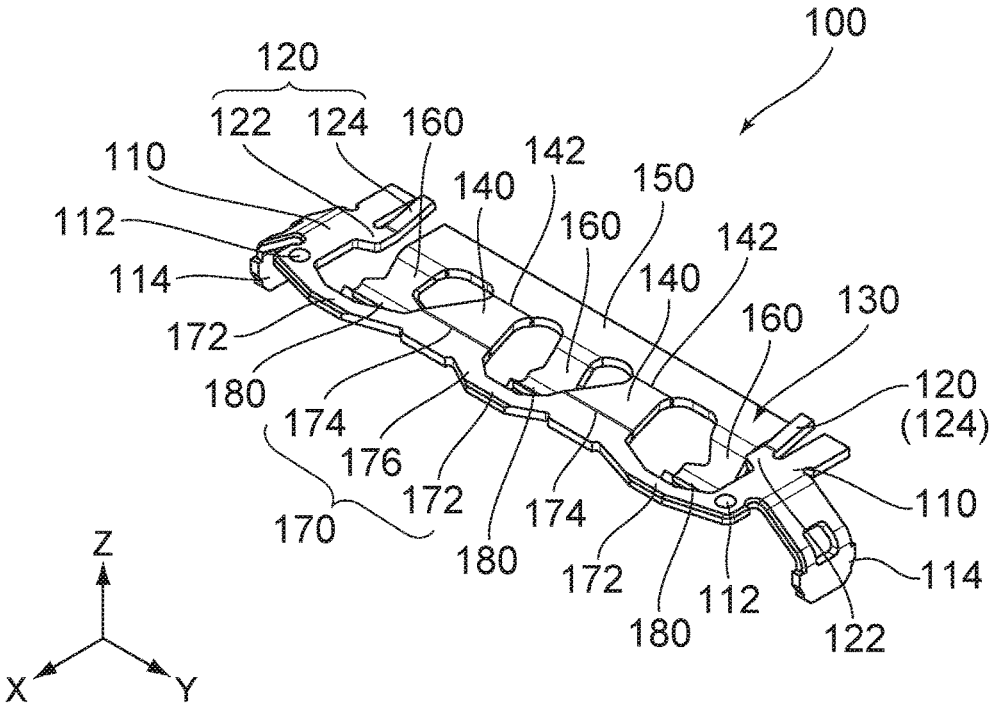
FIG. 6 is a perspective view showing a ground member of FIG. 3.
Figure 7:
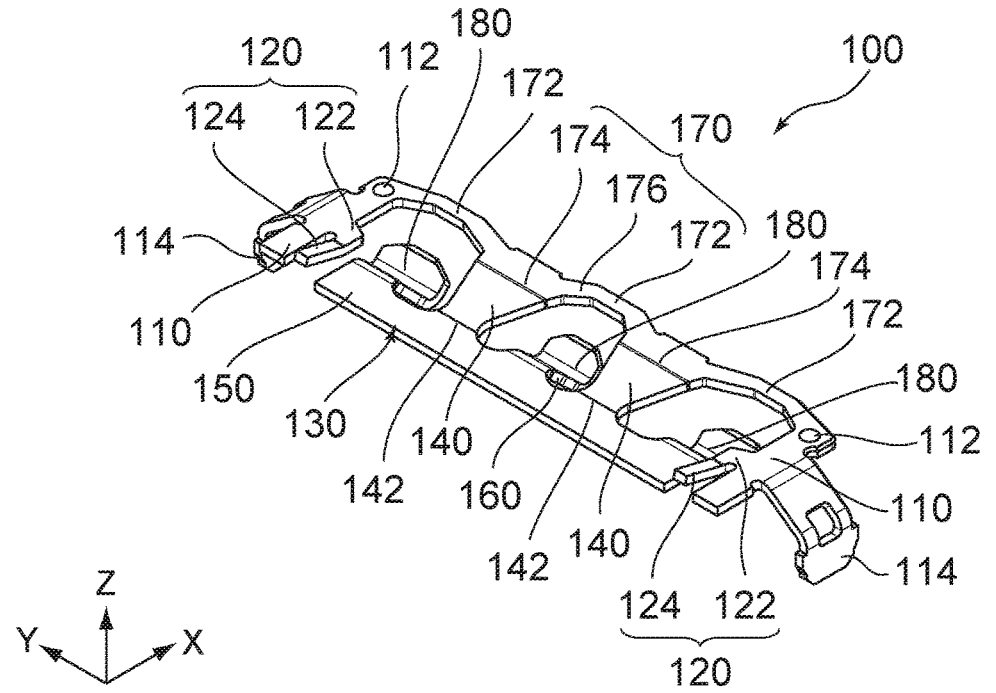
FIG. 7 is another perspective view showing the ground member of FIG. 6.
Figure 8:
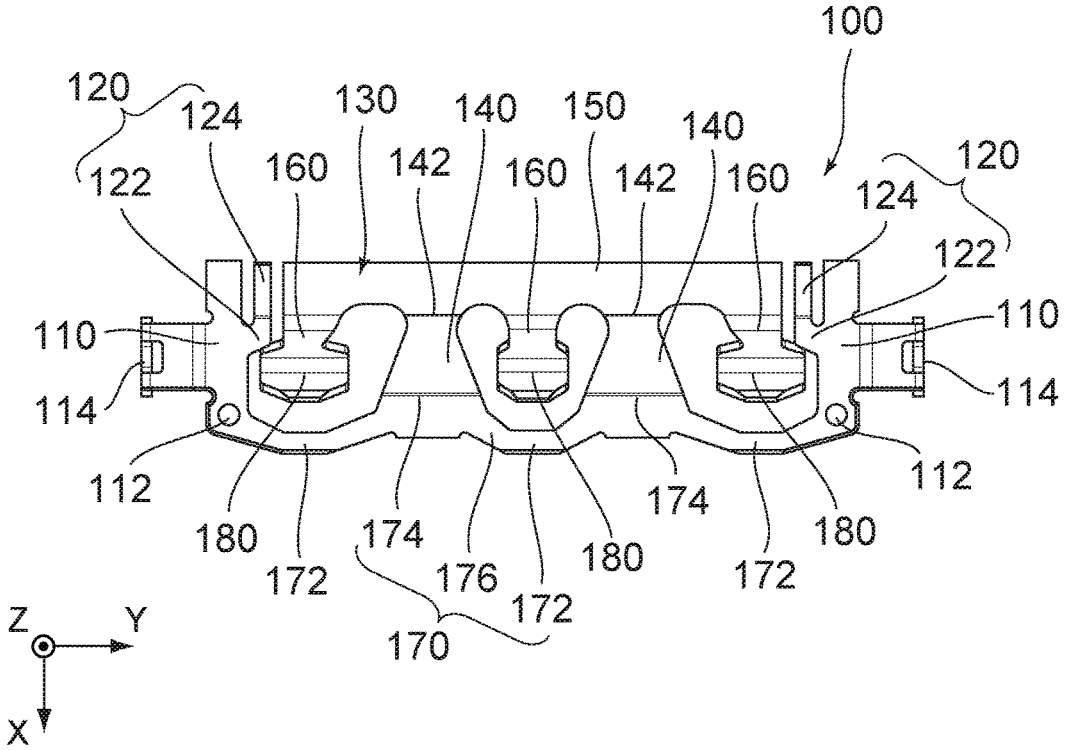
FIG. 8 is a top view showing the ground member of FIG. 6.

As shown in FIGS. 6 to 8, the ground member 100 of the present embodiment has two base portions 110, two spring pieces 120, a ground spring portion 130 and three ground contact point portions 180. The spring pieces 120 extend from the base portions 110, respectively. The ground spring portion 130 extends independently of the spring pieces 120 from the base portions 110. The ground spring portion 130 has an additional spring portion 170, two first spring portions 140, one second spring portion 150 and three third spring portions 160. The additional spring portion 170 couples between the two base portions 110. The ground contact point portion 180 is connected to the mating ground portion (not shown) of the mating connector (not shown). The ground contact point portions 180 are supported by the third spring portions 160, respectively.

As shown in FIGS. 6 to 8, the two base portions 110 are located apart from each other in the lateral direction. Each of the base portions 110 has a slender plate-like shape extending in the front-rear direction. Referring to FIGS. 5 and 6, press-fit portions 114 to be press-fitted into the primary member 25 extend from the base portions 110. As shown in FIGS. 6 to 8, the base portions 110 are provided with regulated portions 112. The regulated portions 112 of the present embodiment are protrusions protruding outward in the up-down direction. As shown in FIG. 10, the base portion 110 is mounted on the reference surface portion 41 of the partition wall 40. Furthermore, the regulated portion 112 is sandwiched between the shell 70 and the holding member 20 so that the movement thereof is regulated, and thereby the base portion 110 is pressed against the reference surface portion 41.

As shown in FIGS. 6 to 8, each of the spring pieces 120 has an L-shape which consists of a short portion 122 and a long portion 124. Each of the spring pieces 120 extends from the base portion 110 corresponding thereto in the lateral direction. In detail, the short portion 122 extends from the base portion 110 in the lateral direction while the long portion 124 extends diagonally rearward from the short portion. As shown in FIG. 11, the long portion 124 of the spring piece 120 is pressed against the shell 70 and electrically connected to the shell 70.

As shown in FIGS. 6 to 8, the additional spring portion 170 couples the two base portions 110 together in the lateral direction. In other words, the additional spring portion 170 extends from the base portions 110 in the lateral direction. The additional spring portion 170 has first front end portions 172, second front end portions 174 and coupling portions 176 which couple them to each other. The first front end portions 172 are located at positions overlapping with the ground contact point portions 180 in the lateral direction and located forward of the ground contact point portions 180 in the front-rear direction. The second front end portions 174 are located apart from the first front end portions 172 in the lateral direction and located rearward of the first front end portions 172 in the front-rear direction. In other words, the additional spring portion 170 has a convexo-concave shape. As understood from FIGS. 5, 9, and 14, the additional spring portion 170 is located on the additional regulating portion 48. The additional regulating portion 48 and the front wall 50 have the convexo-concave shape in conformity with the shape of the additional spring portion 170. Accordingly, even if a space is limited in the front-rear direction, a sufficient thickness of the front wall 50 can be secured so that strength of the holding member 20, in particular of the primary member 25, is can be secured. In the state where the additional spring portion 170 is arranged on the additional regulating portion 48, a gap is provided between the additional spring portion 170 and the shell 70. In other words, a distance between the additional regulating portion 48 and the shell 70 is larger than a size (or thickness) of the additional spring portion 170 in the up-down direction. Accordingly, the additional spring portion 170 of the present embodiment can be resiliently bent between the shell 70 and the additional regulating portion 48 and can exhibit spring property.

As shown in FIGS. 6 to 8, the two first spring portions 140 are located inward of the two base portions 110 in the lateral direction and located apart from each other. Each of the first spring portions 140 extends rearward from the second front end portion 174 of the additional spring portion 170 in the front-rear direction. That is, the second front end portion 174 is a front end of the first spring portion 140. As shown in FIG. 14, the first spring portion 140 is located above the first regulating portion 44, and movement thereof, which is directed inward in the up-down direction, is regulated by the first regulating portion 44.

As shown in FIGS. 6 to 8, the second spring portion 150 extends in the lateral direction and couples rear ends 142 of the two first spring portion 140 together. In other words, the second spring portion 150 extends from the rear ends 142 of the first spring portions 140 in the lateral direction. As shown in FIGS. 13 and 14, the second spring portion 150 is located above the second regulating portion 46, and inward movement of the second spring portion 150 in the up-down direction is regulated by the second regulating portion 46.

As shown in FIGS. 6 to 8, one of the three third spring portions 160 is located inward of the two first spring portions 140 in the lateral direction, and the remaining two are located outward of the two first spring portions 140 in the lateral direction. Each of the third spring portions 160 extends forward from the second spring portion 150 in the front-rear direction. As shown in FIGS. 12 and 13, the third spring portion 160 extends into the connection space 35 through the aperture 42. Thus, the ground contact point portion 180 is supported by the third spring portion 160 and protrudes into the connection space 35.

Referring to FIGS. 10 and 14, the base portion 110, the first spring portion 140 and the second spring portion 150 are accommodated in the ground accommodation portion 75. Referring to FIGS. 9, 12 and 13, the third spring portions 160 and the ground contact point portions 180 are arranged corresponding to the apertures 42. However, the present invention is not limited thereto. For example, the aperture 42 may be enlarged without providing the first regulating portions 44 and the second regulating portion 46 to the partition wall 40 so that the first spring portions 140 and the second spring portion 150 directly face the connection space 35.

As understood from FIG. 14, since a size (thickness) of the first spring portion 140 is smaller than a gap between the partition wall 40 and the shell 70 in the up-down direction, the first spring portion 140 can be resiliently bent between the partition wall 40 and the shell 70. Moreover, as understood from FIGS. 12 to 14, since a size (thickness) of the second spring portion 150 is smaller than the gap between the partition wall 40 and the shell 70 in the up-down direction, the second spring portion 150 can be resiliently bent between the partition wall 40 and the shell 70. Furthermore, as understood from FIGS. 12 and 13, since the third spring portion 160 extends into the aperture 42, the third spring portion 160 can be resiliently bent. Therefore, the ground spring portion 130 having the first through the third spring portions 140-160 can exhibit spring property. Thus, the ground spring portion 130 has at least a spring length decided by the first through the third spring portions 140-160 for each of the ground contact point portions 180. Namely, according to the present embodiment, a long spring length can be obtained in the space limited in the front-rear direction. Particularly, the ground spring portion 130 of the present embodiment is further provided with the additional spring portion 170 having the spring property. Consequently, a longer spring length can be obtained in comparison with a case where the ground spring portion 130 consists of the first through the third spring portions 140-160. As a result, displacement amount of the ground contact point portion 180 becomes larger, and therefore larger contact force can be obtained.

Especially, as shown in FIG. 14, the second spring portion 150 (i.e. the rear end 142 of the first spring portion 140) is located between the front end of the first spring portion 140 (the second front end portion 174) and the ground contact point portion 180 in the up-down direction. In other words, the second spring portion 150 is located inward of the front end of the first spring portion 140 in the up-down direction. Accordingly, relatively large space exists outward of the second spring portion 150 in the up-down direction. In the space, the second spring portion 150 can be resiliently bent, and flection of the first spring portion 140 can be enlarged.

Therefore, the displacement amount of the ground contact point portion 180 can be still larger in comparison with a case where the front end of the first spring portion 140 (the second front end portion 174) and the rear end 142 are located at the same position as each other in the up-down direction. Consequently, further large contact force can be obtained.

As understood from FIG. 12, a position of the ground member 100 does not overlap with a position of the contact 60 in the front-rear direction. That is, the ground member 100 and the contact 60 are located at different positions from each other in the front-rear direction. In other words, the ground member 100 and the contact 60 do not overlap with each other when the ground member 100 and the contact 60 are seen through other members than the ground member 100 and the contact 60 in an orthogonal direction (e.g. the Y-direction or the Z-direction) orthogonal to the front-rear direction. Accordingly, no matter how much the ground spring portion 130 is deformed, it never comes into contact with the contact 60.

Additionally, in a case where the contacts 60 include a ground contact, the ground contact may be located at the same position as that of the ground member 100 in the front-rear direction. For example, in a case where a position of the base portion 110 and a position of the ground contact are same as each other in the lateral direction, the position of the base portion 110 and the position of the ground contact may overlap with each other in the front-rear direction. However, in such a case, in order to avoid certainly that the ground spring portion 130 and the contacts 60 come into contact with each other, it is desirable that the position of the ground spring portion 130 does not overlap with the position of the contact 60 in the front-rear direction. That is, it is desirable that the ground spring portion 130 and the contacts 60 are located at different positions from each other in the front-rear direction. In other words, it is desirable that the ground spring portion 130 and the contacts 60 do not overlap with each other when the ground spring portion 130 and the contacts 60 are seen through other members than the ground member 100 and the contacts 60 in an orthogonal direction (e.g. the Y-direction or the Z-direction) orthogonal to the front-rear direction.

Although the specific explanation about the present invention is made above referring to the embodiments, the present invention is not limited thereto but susceptible to various modifications and so on.

Although the ground member 100 includes the additional spring portion 170 in the aforementioned embodiment, the additional spring portion 170 may be omitted functionally. For example, the regulated portion 112 may be provided at the position of the second front end portion 174 to fix the additional spring portion 170 between the shell 70 and the holding member 20 and to eliminate the spring property of the additional spring portion 170, and the base portion 110 may extend to the position at which the additional spring portion 170 is provided.

Although the additional spring portion 170 has the convexo-concave shape in the aforementioned embodiment, in a case where there is a dimensional clearance in the front-rear direction, the additional spring portion 170 may be formed straight, and the thickness of the front wall 50 may be fixed.

The present invention is based on Japanese Patent Application No. JP2014-114208 filed before the Japanese Patent Office on Jun. 2, 2014, the content of which forms a part of the present application by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

REFERENCE SIGNS LIST

10 Connector
12 Front End
20 Holding Member
25 Primary Member
30 Secondary Member
35 Connection Space
40 Partition Wall
41 Reference Surface Portion
42 Aperture
44 First Regulating Portion
46 Second Regulating Portion
48 Additional Regulating Portion
50 Front Wall
60 Contact
62 Contact Point
64 Connection Portion
65 Ground Plate
70 Shell
75 Ground Accommodation Portion
100 Ground Member
110 Base Portion
112 Regulated Portion
114 Press-Fit Portion
120 Spring Piece
122 Short Portion
124 Long Portion
130 Ground Spring Portion
140 First Spring Portion
142 Rear End
150 Second Spring Portion
160 Third Spring Portion
170 Additional Spring Portion
172 First Front End Portion
174 Second Front End Portion
176 Coupling Portion
180 Ground Contact Point Portion
200 Relay Board
202 Pad

The invention claimed is:

1. A connector mateable with a mating connector, which has a mating ground portion, in a front-rear direction, wherein:

the connector comprises a holding member, a contact, a shell and a ground member;

the holding member is made of insulator defining a connection space;

the contact has a contact point;

the contact is held by the holding member;

the contact point is located inside the connection space;

the shell covers the holding member at least in part;

the ground member is electrically connected to the shell;

the ground member has a base portion, a ground spring portion and a ground contact point portion;

the base portion is located between the holding member and the shell;

the base portion is provided with a regulated portion sandwiched between the shell and the holding member, movement of the regulated portion being regulated;

the ground spring portion extends from the base portion;

the ground spring portion has a first spring portion, a second spring portion and a third spring portion;

the first spring portion extends rearward in the front-rear direction;

the second spring portion extends from a rear end of the first spring portion in a lateral direction perpendicular to the front-rear direction;

the third spring portion extends forward in the front-rear direction from the second spring portion;

the ground contact point portion is connected to the mating ground portion when the connector is mated with the mating connector;

the ground contact point portion is supported by the third spring portion and protrudes into the connection space; and a position of the ground spring portion does not overlap with a position of the contact in the front-rear direction.

2. The connector as recited in claim 1, wherein a position of the ground member does not overlap with the position of the contact in the front-rear direction.

3. The connector as recited in claim 1, wherein:

a ground accommodation portion is formed between the shell and the holding member; and the ground accommodation portion accommodates at least the first spring portion, the second spring portion and the base portion.

4. The connector as recited in claim 3, wherein:

the holding member is formed with a partition wall and an aperture;

the partition wall separates the ground accommodation portion and the connection space from each other;

the aperture penetrates the partition wall; and the third spring portion and the ground contact point portion are arranged corresponding to the aperture.

5. The connector as recited in claim 4, wherein:

the partition wall has a first regulating portion, which regulates movement of the first spring portion, and a second regulating portion, which regulates movement of the second spring portion; and the first regulating portion extends diagonally to be directed inward in an up-down direction perpendicular to both of the front-rear direction and the lateral direction and to be directed rearward in the front-rear direction.

6. The connector as recited in claim 1, wherein the ground member is further provided with a spring piece which is pressed against the shell.

7. The connector as recited in claim 6, wherein:

the base portion extends in the front-rear direction; and the spring piece has an L-shape and extends from the base portion in the lateral direction.

8. The connector as recited in claim 1, wherein:

the ground spring portion further comprises an additional spring portion extending from the base portion in the lateral direction; and the first spring portion extends rearward in the front-rear direction from the additional spring portion.

9. The connector as recited in claim 8, wherein:

the additional spring portion has a first front end portion, a second front end portion and a coupling portion;

the first front end portion is located forward of the ground contact point portion in the front-rear direction and located at a position overlapping with the ground contact point portion in the lateral direction;

the second front end portion is located rearward of the first front end portion in the front-rear direction and located apart from the first front end portion in the lateral direction;

the coupling portion couples the first front end portion and the second front end portion to each other; and the first spring portion extends from the second front end portion.

10. The connector as recited in claim 8, wherein:

the ground member comprises two of the base portions, two of the first spring portions, three of the third spring portions and three of the ground contact point portions;

the two base portions are located apart from each other in the lateral direction;

the additional spring portion connects the two base portions together in the lateral direction;

the two first spring portions are located inward of the two base portions in the lateral direction;

one of the three third spring portions is located inward of the two first spring portions in the lateral direction while remaining two are located outward of the two first spring portions in the lateral direction; and the three ground contact point portions are held by the three third spring portions, respectively.

11. The connector as recited in claim 1, wherein the second spring portion is located between a front end of the first spring portion and the ground contact point portion in an up-down direction perpendicular to both of the front-rear direction and the lateral direction.

* * * * *